US010407984B2

(12) United States Patent
MacKenzie

(10) Patent No.: US 10,407,984 B2
(45) Date of Patent: Sep. 10, 2019

(54) ADJUSTABLE PLATFORM SYSTEM

(71) Applicant: THE BOEING COMPANY, Chicago, IL (US)

(72) Inventor: Rod M. MacKenzie, Everett, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/353,204

(22) Filed: Nov. 16, 2016

(65) Prior Publication Data

US 2018/0135315 A1 May 17, 2018

(51) Int. Cl.

| | |
|---|---|
| ***E06C 7/14*** | (2006.01) |
| ***E04G 1/20*** | (2006.01) |
| ***E04G 1/28*** | (2006.01) |
| ***E04G 1/34*** | (2006.01) |
| ***E04G 5/00*** | (2006.01) |
| ***E04G 5/14*** | (2006.01) |
| *E04G 1/24* | (2006.01) |
| *E06C 1/39* | (2006.01) |
| *E06C 1/397* | (2006.01) |
| *E06C 7/06* | (2006.01) |
| *E06C 7/16* | (2006.01) |
| *E06C 7/18* | (2006.01) |

(52) U.S. Cl.

CPC ..... *E06C 7/14* (2013.01); *E04G 1/20* (2013.01); *E04G 1/28* (2013.01); *E04G 1/34* (2013.01); *E04G 5/003* (2013.01); *E04G 5/141* (2013.01); *E04G 2001/242* (2013.01); *E06C 1/39* (2013.01); *E06C 1/397* (2013.01); *E06C 7/06* (2013.01); *E06C 7/16* (2013.01); *E06C 7/182* (2013.01); *E06C 7/185* (2013.01)

(58) Field of Classification Search

CPC .... E04G 1/18; E04G 1/24; E04G 1/20; E04G 1/28; E04G 1/34; E04G 5/003; E04G 5/141; E04G 2001/242; E04G 7/14; E06C 7/14; E06C 1/39; E06C 1/397; E06C 1/06; E06C 1/16; E06C 1/182; E06C 1/185

USPC .... 312/235.1; 108/92, 93, 102, 107, 157.18, 108/158.12; 182/21, 35, 115

See application file for complete search history.

(56) References Cited

U.S. PATENT DOCUMENTS

| | | | | | |
|---|---|---|---|---|---|
| 487,117 | A * | 11/1892 | Farner | A47B 63/02 | 182/35 |
| 827,050 | A * | 7/1906 | Weston | A47B 87/02 | 108/93 |
| 1,267,524 | A * | 5/1918 | Ewart | A47B 13/081 | 108/102 |
| 1,979,301 | A * | 11/1934 | Webb | A47B 13/16 | 108/26 |
| 2,437,665 | A * | 3/1948 | Rose | A47B 77/04 | 108/102 |
| 2,588,783 | A * | 3/1952 | Wetzel | E04H 3/123 | 188/5 |

(Continued)

*Primary Examiner* — Katherine W Mitchell
*Assistant Examiner* — Shiref M Mekhaeil
(74) *Attorney, Agent, or Firm* — Joseph M. Butscher; The Small Patent Law Group, LLC

(57) ABSTRACT

A platform system is configured to allow an individual to be supported at a plurality of different heights, and includes a frame defining a plurality of platform adjustment levels, and an upper support platform that is configured to be selectively moved between the plurality of platform adjustment levels to provide the plurality of different heights.

18 Claims, 7 Drawing Sheets

(56) References Cited

U.S. PATENT DOCUMENTS 3,488,066 A * 1/1970 Hansen ..... B60R 3/02 280/163
4,067,598 A * 1/1978 Mansour ..... E05C 19/003 292/259 R
4,116,457 A * 9/1978 Nerem ..... B60R 3/02 280/166
4,180,143 A * 12/1979 Clugston ..... B60R 3/02 182/91
4,185,716 A * 1/1980 Rinehart ..... B66F 11/044 182/113
4,462,486 A * 7/1984 Dignan ..... B60R 3/02 182/91
4,782,914 A * 11/1988 Nail ..... E04G 5/14 182/113
4,846,304 A * 7/1989 Rasmussen ..... A47B 77/10 182/129
5,005,667 A * 4/1991 Anderson ..... A47B 77/10 182/15
5,070,963 A * 12/1991 Fusco ..... E06C 1/005 182/135
5,072,955 A * 12/1991 Holland ..... B25H 1/16 182/116
5,145,030 A * 9/1992 Pavlescak ..... E04G 5/14 182/113
5,282,656 A * 2/1994 Fizer ..... E05C 19/003 292/259 R
5,718,441 A * 2/1998 Kern ..... A47B 57/14 211/187
6,439,342 B1 * 8/2002 Boykin ..... A47B 67/04 182/35
6,471,002 B1 * 10/2002 Weinerman ..... B60R 3/02 182/90
7,017,708 B1 * 3/2006 Lynn ..... E06C 1/005 182/35
7,815,266 B2 * 10/2010 Sun ..... G06F 1/18 312/223.1
8,627,925 B2 * 1/2014 Webster ..... B66F 9/127 182/113
8,782,958 B2 * 7/2014 Rivera, Jr. ..... E04H 3/126 108/169
8,833,520 B2 * 9/2014 Pizzolato ..... E02D 29/12 160/135
8,905,354 B2 * 12/2014 Griffiths ..... B64C 1/24 182/89
9,038,216 B2 * 5/2015 Buege ..... A61G 13/0018 5/611
D763,534 S * 8/2016 Liao ..... D34/21
2001/0045718 A1 * 11/2001 Boirum ..... B25H 3/02 280/47.26
2003/0047382 A1 * 3/2003 Panacci ..... E04G 5/00 182/113
2003/0067176 A1 * 4/2003 Stevens ..... E05B 17/2084 292/339
2003/0075384 A1 * 4/2003 Pickering ..... A47C 9/025 182/116
2005/0034922 A1 * 2/2005 Wyse ..... E04G 1/15 182/119
2006/0191449 A1 * 8/2006 Patten ..... A47B 46/005 108/138
2007/0221442 A1 * 9/2007 R.C. ..... B60R 3/02 182/88
2008/0000722 A1 * 1/2008 Winslow ..... E04G 5/00 182/129
2008/0157500 A1 * 7/2008 Raley ..... E06C 1/387 280/166
2008/0264723 A1 * 10/2008 Tatum ..... A47C 12/00 182/35
2009/0096231 A1 * 4/2009 Burlingame ..... B66F 11/04 294/68.3
2009/0101437 A1 * 4/2009 Abraham ..... B62B 5/0083 182/129
2009/0188754 A1 * 7/2009 Warren ..... E06C 1/397 182/141
2009/0194959 A1 * 8/2009 Mintie ..... B62B 3/02 280/47.131
2010/0089697 A1 * 4/2010 Kreller ..... E04G 1/14 182/113
2010/0232917 A1 * 9/2010 Strahler ..... B28C 5/4237 414/540
2011/0253476 A1 * 10/2011 Earl ..... B66F 7/02 182/69.6
2012/0222913 A1 * 9/2012 Calvert ..... E04G 1/30 182/20
2012/0325584 A1 * 12/2012 Podzimek ..... B25H 5/00 182/141
2015/0033786 A1 * 2/2015 Mansfield ..... F25D 23/12 62/449
2016/0115006 A1 * 4/2016 Presti ..... B66F 11/042 182/19

* cited by examiner

ADJUSTABLE PLATFORM SYSTEM

FIELD OF THE DISCLOSURE

Embodiments of the present disclosure generally relate to an adjustable platform system including at least one support platform that is configured to be adjusted between a plurality of levels.

BACKGROUND OF THE DISCLOSURE

Ladders are used to allow individuals to reach different heights for various reasons. In manufacturing environments, ladders are typically used so that individuals may work on components that are at elevated heights. For example, ladders may be used so that individuals may work on various portions of a wing of an aircraft that are otherwise unreachable without a ladder.

Once on a ladder, a range of motion of motion of an individual is generally limited. For example, the ladder needs to be moved to different locations of a particular component in order for an individual to gain access thereto. Further, support rungs or surfaces on ladders are relatively small, and often do not allow an individual to freely and safely maneuver with respect to different orientations and positions.

Also, many ladders are relatively unstable. If an individual leans to a side, back, or forward, many ladders may be susceptible to tipping over, which may cause injuries to an individual on the ladder.

Further, ladder rungs or other such support surfaces are fixed in position. Typically, adjacent ladder rungs are separated by a distance of approximately 12 inches. As such, an individual may step up or down on the ladder in such fixed increments. However, by stepping up to a higher rung, the individual may be positioned over a desired position. Further, by remaining on a lower rung, the individual may not be tall enough to safely reach the desired position.

SUMMARY OF THE DISCLOSURE

A need exists for a stable, portable, and maneuverable standing platform. A need exists for a standing platform that allows individuals to safely and freely maneuver thereon. A need exists for an adjustable and adaptable standing platform.

With those needs in mind, certain embodiments of the present disclosure provide a platform system that is configured to allow an individual to be supported at a plurality of different heights. The platform system includes a frame defining a plurality of platform adjustment levels, and an upper support platform that is configured to be selectively moved between the plurality of platform adjustment levels to provide the plurality of different heights. In at least one embodiment, the upper support frame is configured to be completely removed from a first platform adjustment level of the frame and inserted into a second platform adjustment level of the frame. The first platform adjustment level may be spaced from the second platform adjustment level a distance of two inches.

In at least one embodiment, a base step is moveably coupled to the frame. The base step is below the upper support frame. The base step is configured to be outwardly moved between a fully retracted position and a fully extended position. The base step may include a handle that is configured to be grasped.

In at least one embodiment, a moveable intermediate transition step is underneath the upper support platform. The intermediate transition step is moveably coupled to the base step through at least one pivotal link. The intermediate transition step upwardly extends when the base step is in the fully extended position.

The frame may include a plurality of rails. The plurality of platform adjustment levels may be defined between the plurality of rails.

Casters may be connected to the frame. The casters are configured to allow the platform system to be moved to different locations. Handles may extend from the frame. The handles are configured to be grasped to tilt the platform system onto the casters.

The frame may include a plurality of beams that provide barriers that restrain movement of the individual. At least one of the plurality of beams may include a moveable safety beam that is configured to be moved between closed and open positions.

A support tray may be moveably coupled to the frame. The support tray may be configured to be adjusted to different heights and locked in place by at least one bracing lock. In at least one embodiment, the support tray defines an open channel that is configured to receive a container.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Embodiments of the present disclosure provide a portable, adjustable, and adaptable platform system. The platform system includes an upper support platform that is configured to be adjustably positioned between a plurality of different levels. In at least one embodiment, the upper support platform is adjustable in 2 inch increments. The platform system also includes an extendable base step. A transition step is moveably coupled to the base step. The base step and the transition step cooperate to allow an individual to safely and easily step up to the upper support platform.

Certain embodiments of the present disclosure provide a portable elevated platform system. The elevation of an upper platform is adjustable. Rails keep an operator within the platform area. The rails may include a moveable element that is latchable in a closed position to contain the platform surface all around a perimeter of the platform system. The platform system may include one or more retractably movable steps to enable access to the elevated platform surface. The platform system may also include a retractably movable storage element to support objects distinct from the platform structure, such as tools or parts. The support platform is adjustably positionable within one or more pairs of slots located on opposing sides of the platform structure. The platform system may also include wheels to enable rolling movement of the elevated platform assembly when the platform assembly is angled to at least a predetermined angle.

Figure 1:
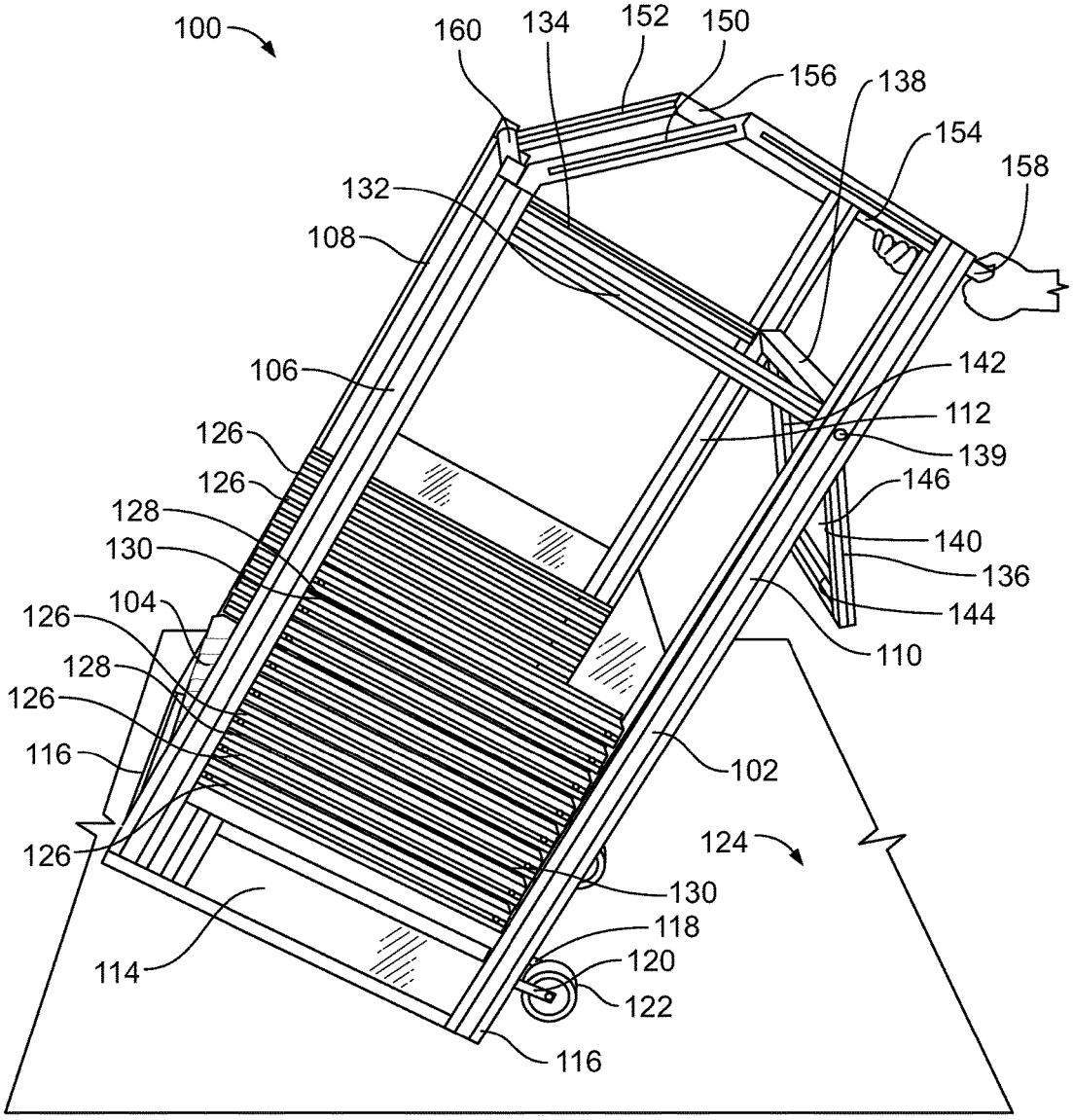
FIG. 1 illustrates a perspective lateral view of a platform system, according to an embodiment of the present disclosure.

FIG. 1 illustrates a perspective lateral view of a platform system 100, according to an embodiment of the present disclosure. The platform system 100 includes a frame 102 that adjustably retains an upper support platform 104. The upper support platform 104 is configured to be moveably adjusted between a plurality of different levels.

The frame 102 includes parallel front posts 106 and 108 and parallel rear posts 110 and 112, which are also parallel to the front posts 106 and 108. Bottom ends of the posts 106, 108, 110, and 112 are connected together by lateral base step covering walls 114 and a rear cross beam 116. Casters 118 outwardly extend from rear surfaces of the posts 110 and 112 proximate to the rear cross beam 116. Each of the casters 118 includes coupling bearings 120 (such as lugs, brackets, or the like) that extend from the posts 110 and 112. The bearings 120 rotatably retain wheels 122. As shown, when the frame 102 is tilted back a predetermined angle, the wheels 122 contact a floor 124, thereby allowing the platform system 100 to be maneuvered and moved.

A plurality of lateral support rails 126 extend between the posts 106 and 110 and the posts 108 and 112 above the base step covering walls 114. Platform adjustment slots 128 are positioned between neighboring (that is, adjacent or otherwise immediately closest) rails 126 between the posts 106 and 110 and the posts 108 and 112. Opposed, aligned platform adjustment slots 128 provide a plurality of platform adjustment levels 130 at which the upper support platform 104 may be adjustably positioned.

Neighboring (that is, those that are vertically closest to one another) platform adjustment levels 130 may be separated a distance of two inches. The platform system 100 may include twelve platform adjustment levels 130. As such, the upper support platform 104 may be adjusted over a twenty-four inch range in increments of two inches. Unlike ladders that have fixed rungs separated by a distance of twelve inches, for example, the platform system 100 allows the upper support platform 104 to be adjusted over a wide range of heights at incremental distances, such as two inch increments. Optionally, neighboring platform adjustment levels 130 may be separated by distances of greater or less than two inches. Further, the platform system 100 may include more or less than twelve platform adjustment levels 130.

The frame 102 may also include lateral bracing beams 132 and 134 extending between the posts 106 and 110 and the posts 108 and 112, respectively. The bracing beams 132 and 134 may be fixed in position, and are located at a height that provides a safety barrier for an individual standing on the upper support platform 104. A rear bracing beam may also extend between the posts 110 and 112. The rear bracing beam may be at the same level as the restraining beams 132 and 134. Optionally, the frame 102 may not include the lateral bracing beams 132, 134, and/or the rear bracing beam.

A support tray 136 may be pivotally coupled between the posts 110 and 112. The support tray 136 may include a pivot bracket 138 pivotally coupled to interior portions of the posts 110 and 112 through one or more pivot pins 139. Lateral beams 140 and 142 extend from the pivot bracket 138. Distal ends of the lateral beams 140 and 142 connect to an outer cross beam 144. The support tray 136 may define an open channel 146 between the pivot bracket 138, the lateral beams 140, 142, and the outer cross beam 144. The support tray 136 is configured to receive a separate container, such as a bucket, tray, and/or the like, so that the container may be securely retained between the pivot bracket 138, the lateral beams 140, 142, and the outer cross beam 144. In at least one other embodiment, the support tray 136 may provide a contiguous, flat, planar support surface between the pivot bracket 138, the lateral beams 140, 142, and the outer cross beam 144 (instead of defining a channel 146 therebetween).

The frame 102 may also include rearwardly canted beams 150 and 152 that extend upwardly and rearwardly from upper ends of the posts 106 and 108, respectively. The canted beams 150 and 152 connect to lateral restraining beams 154 and 156, respectively, which connect to upper ends of the posts 110 and 112, respectively. The restraining beams 154 and 156 are located at a height that provides a safety barrier for an individual standing on the upper support platform 104. A rear restraining cross beam may extend between the upper ends of the posts 110 and 112, such as at the same level as the restraining beams 154 and 156.

Handles 158 may outwardly extend from the upper ends of the posts 110 and 112. The handles 158 are configured to be grasped by an individual so that the platform system 102 may be pivoted back in order for the wheels 122 of the casters 118 to engage the floor 124, and allow an individual to maneuver the platform system 102 to a different location.

A safety beam 160 may be moveably secured between upper ends of the posts 106 and 108. The safety beam 160 is moveable between a restraining position (as shown in FIG. 1) in which the safety beam 160 is securely coupled to both the posts 106 and 108, and an open position, in which the safety beam 160 is decoupled from one of the posts 106 and 108, and pivoted downwardly, to allow an individual to step onto the upper support platform 104 within the platform system 102. The safety beam 160 may be pivotally coupled to one of the posts 106 or 108, and removably coupled (such as through a latch) to the other of the posts 106 or 108.

Figure 2:
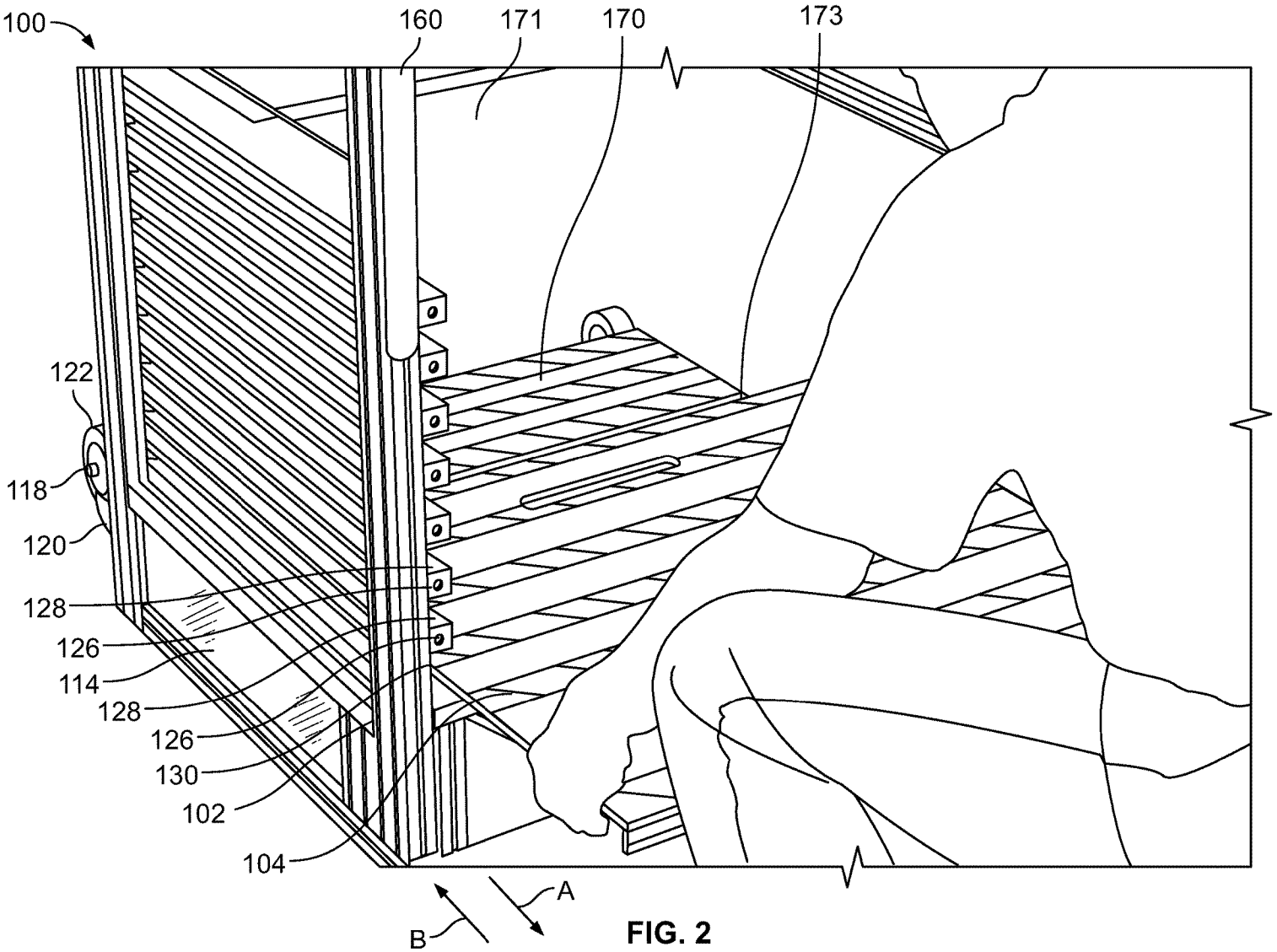
FIG. 2 illustrates a perspective front view of a platform system with an upper support platform being adjusted, according to an embodiment of the present disclosure.

FIG. 2 illustrates a perspective front view of the platform system 100 with an upper support platform 104 being adjusted, according to an embodiment of the present disclosure. In order to position the upper support platform 104 to a desired height, the upper support platform 104 may be outwardly slid in the direction of arrow A from a platform adjustment level 130 defined between neighboring parallel rails 126. As the upper support platform 104 is slid outwardly from the frame 102, an intermediary transition step 170 is exposed within the frame 102.

As shown in FIG. 2, the upper support platform 104 is initially positioned at a first platform adjustment level 130. In order to adjust the upper support platform 104 to a second platform adjustment level 130 that differs from the first platform adjustment level 130, the upper support platform 104 is linearly slid out from the first platform adjustment level 130 in the longitudinal direction of arrow A. After the upper support platform 104 is completely removed from the frame 102, the upper support platform 104 is aligned with the second platform adjustment level 130 and linearly slid therein in the direction of arrow B. The frame 102 may include a rear wall 171 into which a leading edge 173 of the upper support platform 104 abuts into in a secure position, thereby preventing the upper support platform 104 from rearwardly shifting within the frame 102.

Figure 3:
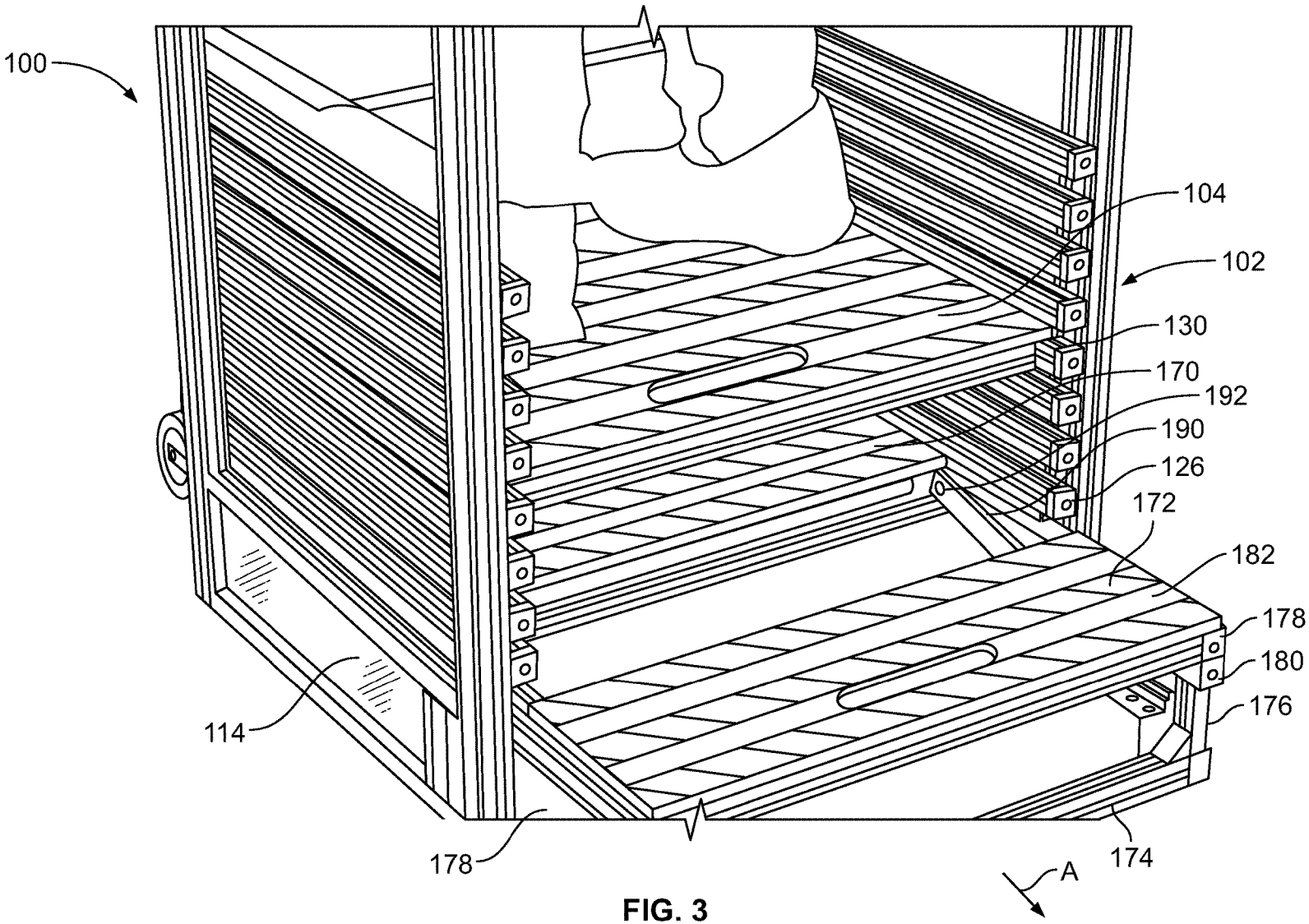
FIG. 3 illustrates a perspective front view of a platform system with an upper support platform at a desired height and a base step outwardly extended from a frame, according to an embodiment of the present disclosure.

FIG. 3 illustrates a perspective front view of the platform system 100 with the upper support platform 104 at a desired height and a base step 172 outwardly extended from the frame 104 according to an embodiment of the present disclosure. The base step 172 is slidably retained by interior tracks of the frame 102 and is configured to be outwardly pulled, to provide a step onto which an individual may step up to the upper support platform 104 at a particular height.

The base step 172 includes a lower base beam 174 coupled to upstanding lateral columns 176 that are perpendicular to the beam 174. Lateral slide rails 178 extend within tracks, such as between rails 126, within the frame 102. A support surface 182 is supported over upper slide rails 178 and the columns 176. The base step 172 is configured to be pulled out of and into the frame 102, such as through the slide rails 178 and 180 slidably engaging lower rails 126. The support surface 182 may include a handle 192 (such as a hole formed therethrough) that allows an individual to grasp and pull the base step 172.

The intermediary transition step 170 is moveably coupled to the base step 172, such as through pivotal links 190. In order for the intermediary transition step 170 to move into an extended support position, the base step 172 is pulled out away from the frame 102 in the direction of arrow A a distance in which restraining couplers, such as restraining pins 192, latches, clasps, or the like extending inwardly from the frame 102, decouple from the links 190. In at least one other embodiment, the links 190 may include outwardly extending restraining couplers that extend into channels formed in the rails 126, for example, and decouple therefrom as the base step 172 is fully extended outwardly from the frame 102. For example, the restraining pins 192 may abut against the rails 126 to retract the intermediary transition step 170 within the frame 102. As the base step 172 is pulled outwardly away from the frame in the direction of arrow A, the pins 192 disengage from the rails 126, and the intermediary transition step 170 moves into an extended position.

Additionally, if the upper support platform 104 is positioned at a particular platform adjustment level 130 that is too low (for example, two, three or four platform adjustment levels 130 above the intermediary transition step 170), a bottom surface of the intermediary transition step 170 may interfere with an upper surface of the intermediary transition step 170. In this manner, the upper support platform 104 at a particular low level prevents the intermediary transition step 170 from extending into a support position.

Figure 4:
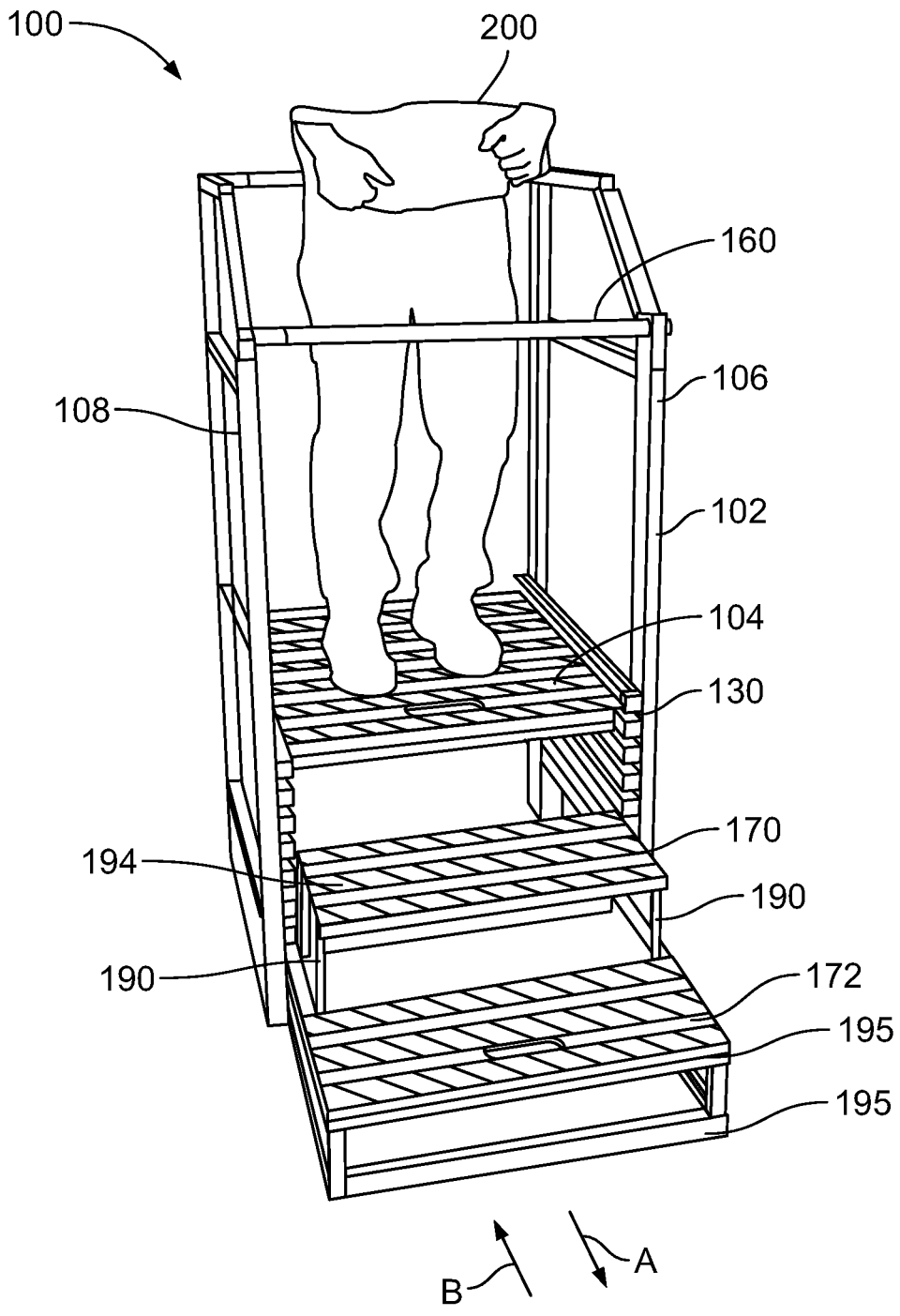
FIG. 4 illustrates a perspective front view of a platform system with an upper support platform at a desired height and a base step and intermediary transition step outwardly extended from a frame, according to an embodiment of the present disclosure.
Figure 5:
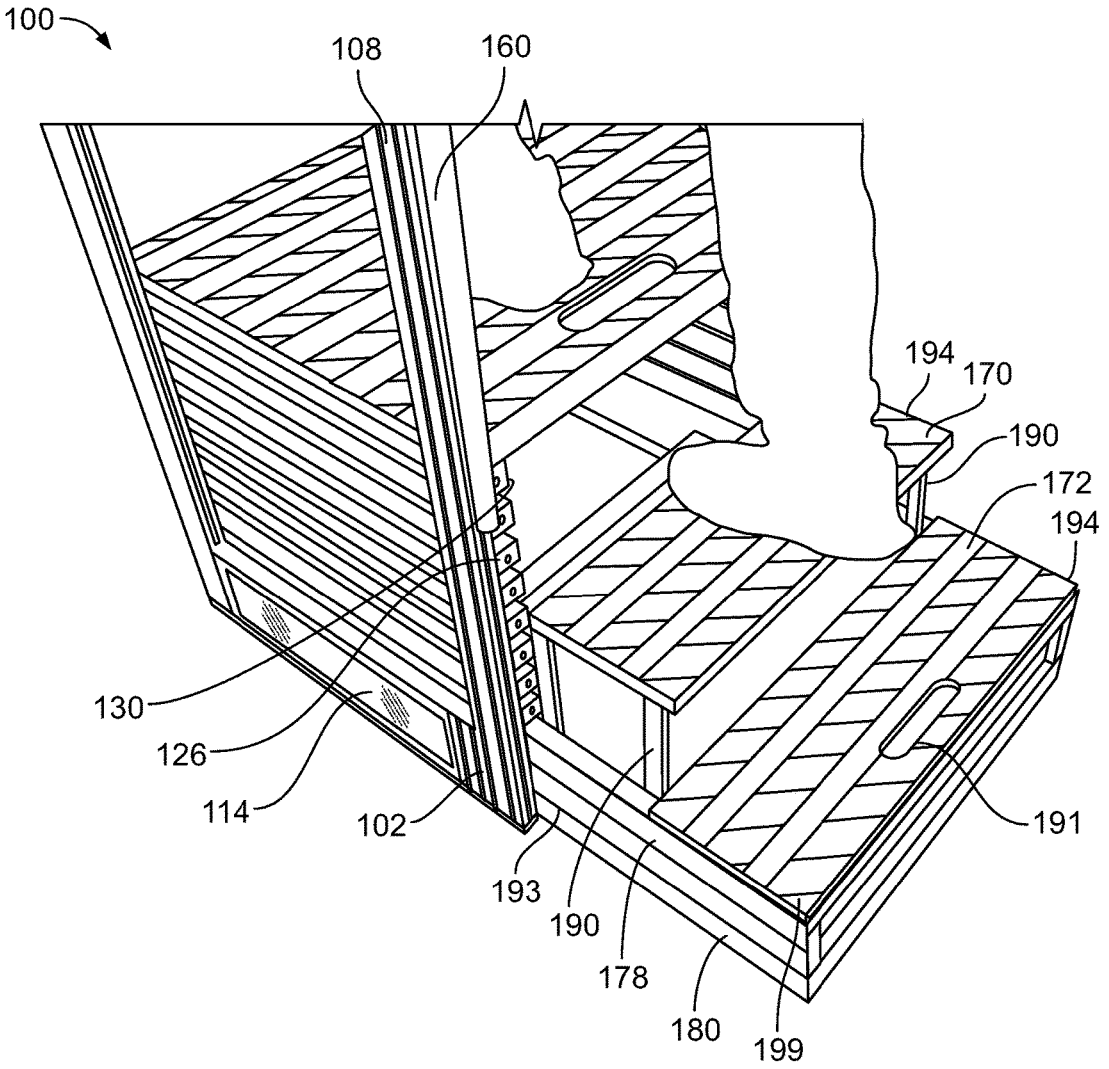
FIG. 5 illustrates a perspective lateral view of a platform system with an upper support platform at a desired height and a base step and intermediary transition step outwardly extended from a frame, according to an embodiment of the present disclosure.

FIG. 4 illustrates a perspective front view of the platform system 100 with the upper support platform 104 at a desired height and the base step 172 and the intermediary transition step 170 outwardly extended from the frame 102 according to an embodiment of the present disclosure. FIG. 5 illustrates a perspective lateral view of the platform system 100 with the upper support platform 104 at a desired height and the base step 172 and the intermediary transition step 170 outwardly extended from the frame 102.

Referring to FIGS. 4 and 5, the upper support platform 104 is positioned at a platform adjustment level 130 that does not interfere with the intermediary transition step 170. As the base step 172 is pulled outwardly from the frame 102 in a fully-extended position, the intermediary transition step 170 follows the base step 172, and the restraining pins 192 (shown in FIG. 3) disengage from the rails 126 and/or the links 190 (shown in FIG. 3), thereby allowing the links 190 to upwardly extend. As such, a support surface 194 of the intermediary transition step 170 supported by the opposed lateral links 190 upwardly extends, and provides a transition step between the base step 172 and the upper support platform 104.

As shown in FIG. 4, the safety beam 160 is coupled to both the posts 106 and 108. As such, the safety beam 160 provides a barrier that restrains motion of an individual 200 standing on the upper support platform 104. The upper support platform 104 provides a large, robust base on which the individual 200 may stand. Unlike rungs of a ladder, the individual 200 may easily and safely move through 360 degrees of motion. The support platform 104 allows the individual to safely step laterally, forward, and aft, as well as rotate to different headings. Further, the extended base step 172 provides the platform system 100 with a stable base that is not susceptible to being tipped over.

In order for the individual 200 to exit the platform system 100, the individual grasps an end of the safety beam 160 and decouples it from one or both of the posts 106 and 108. For example, ends of the safety beam 160 may be latchably coupled to the posts 106 and/or 108. In at least one embodiment, one end of the safety beam 160 is pivotally coupled to one of the posts 106 or 108. As such, when one end of the safety beam 160 is decoupled from a post 106 or 108, the safety beam 160 pivots down to an open position (as shown in FIG. 5) about the pivotal coupling with the post 106 or 108.

The individual 200 then steps down from the platform system 100 via the extended intermediary transition step 170 and the base step 172. The individual 200 may then push the base step 172 back into the frame in the direction of arrow B (which is opposite from the direction denoted by arrow A). As the base step 172 is urged back into the frame 102, the base step 172 forces the links 190 to pivot downwardly until the restraining pins 192 securely couple (for example, latch) the links 190 to the frame 102. With continued urging, the base step 172 and the intermediary transition step 170 recede back into the frame 102 such that front edges 195 of the base step 172 are retained within the frame 102 (or flush with an outer surface of the frame 102), thereby providing a compact system for storage.

As shown in FIGS. 4 and 5, lateral rails or walls 178 and 180 of the base step are slidably retained by lateral tracks 193 within the frame 102. For example, lower rails 126 of the frame 102 may define at least a portion of the tracks 193.

Further, the support surface 182 of the base step 172 has a width such that lateral edges 199 of the support surface 182 fit directly underneath the lower rails 126 in the retracted position. In contrast, the support surface 194 of the intermediary transition step 170 may not be wide enough to fit directly underneath the rails 126 of the frame 102 in a retracted position (thereby allowing the transition step 170 to upwardly pivot into an extended position when the restraining pins 190 decouple the links 190 from the frame 102 when the base step 172 is fully slid out from the frame 102 into a fully extended position). The base step covering walls 114 cover the links 190 and internal portions of the base step 172 and the intermediary transition step 170, thereby protecting such from exterior forces, and reducing a possibility of injury to an individual (as the individual is unable to get fingers caught by the moving links 190, for example).

Figure 6:
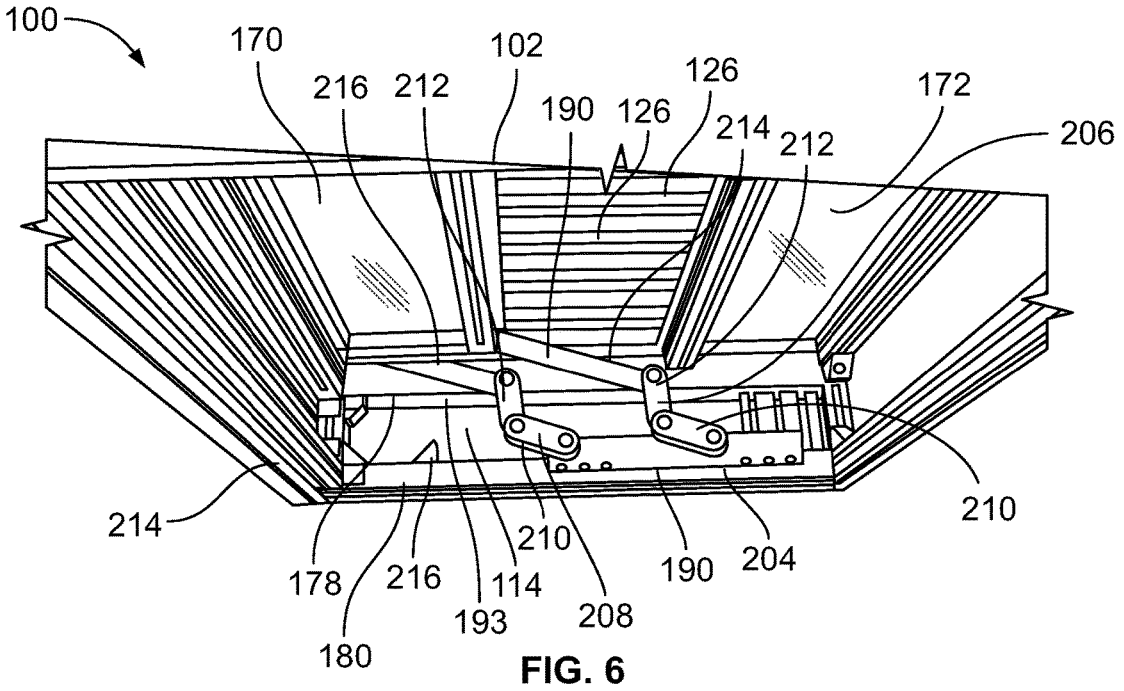
FIG. 6 illustrates a perspective bottom internal view of a base step coupled to an intermediary transition step in a retracted position, according to an embodiment of the present disclosure.

FIG. 6 illustrates a perspective bottom internal view of the base step 172 coupled to the intermediary transition step 170 in a retracted position, according to an embodiment of the present disclosure. The link 190 on one side of the frame 102 is a mirror image to that on an opposite side of the frame 102. The base step 172 includes the slide rails 178 and 180 slidably coupled to the tracks 193 within the frame 102.

Each link 190 includes a slide bracket 204 slidably coupled to an interior portion of the lower slide rail 180. The slide bracket 204 pivotally couples to front and rear coupling beams 206 and 208. A first portion 210 of each coupling beam 206 and 208 connects to an angled second portion 212. The first portion 210 connects to the slide bracket 204, while the second portion 212 connects to a linear extension beam 214 and 216 that pivotally couples to the intermediate transition step 170. In at least one embodiment, the second portions 212 may be integrally formed with the extension beams 214 and 216.

Figure 7:
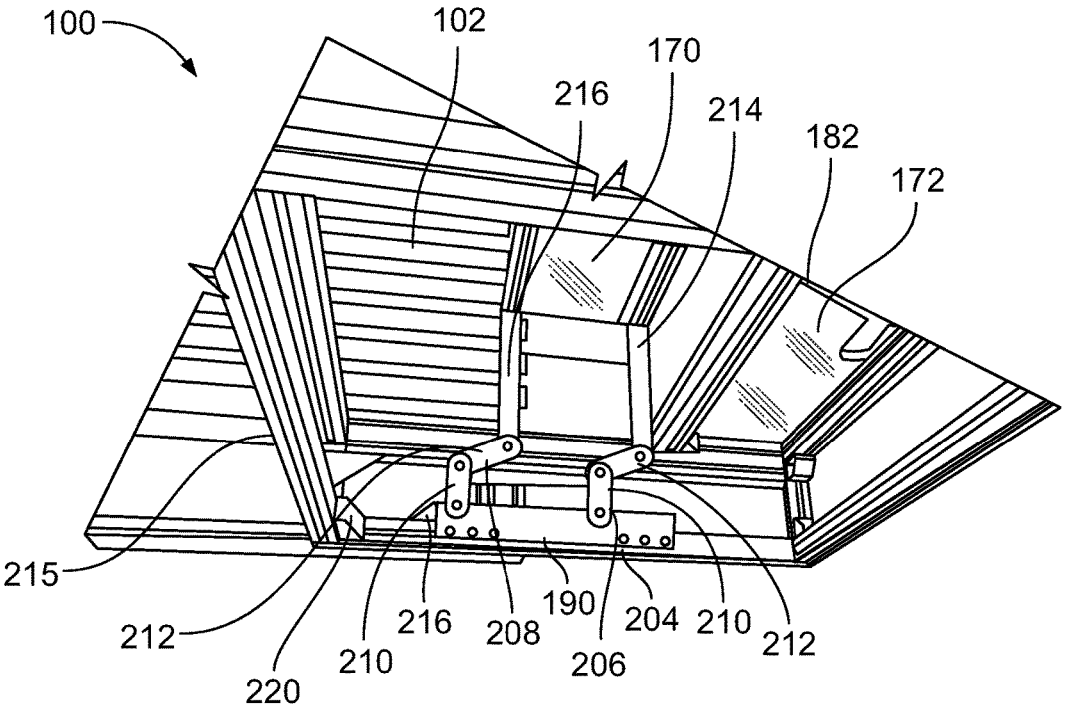
FIG. 7 illustrates a perspective bottom internal view of a base step coupled to an intermediary transition step in a fully extended position, according to an embodiment of the present disclosure.

FIG. 7 illustrates a perspective bottom internal view of the base step 172 coupled to the intermediary transition 170 step in a fully extended position, according to an embodiment of the present disclosure. Referring to FIGS. 6 and 7, as the base step 170 is outwardly pulled from the frame 102, the slide rails 178 and 180 outwardly slide through the tracks 193. During such movement, the intermediary transition step 170 slides outwardly with the base step 172, while a rear end 215 of the bass step 172 moves towards the slide bracket 204 until interior stop protuberances 216 abut against the portions 210 of the rear coupling beams 208. As the base step 172 continues to be outwardly pulled, the protuberances 216 force the rear coupling beams 208 unpwardly, as shown in FIG. 7 (and the front coupling beams 206 move in response thereto). As the coupling beams 206 and 208 pivot upwardly, the linear extension beams 214 and 216 vertically extend as the restraining pins 192 disengage from the frame 102 and/or the links 190.

As shown in FIG. 7, in the fully extended position, the front extension beam 214 may abut into a rear edge of the support surface 182 of the base step 172, while rear protuberances 220 abut into an interior surface 220 of the rear end 215 of the base step 172, thereby securely bracing the intermediary step 170 in a fully extended position. Further, as shown, the extension beams 214 and 216 are disposed at positions that are forward from the points where coupling beams 206 and 208 connect to the slide bracket 204, which also ensures that the intermediary transition step 170 remains in a secure and stable extended position.

In order to retract the intermediary transition step 170, the base step 172 is urged inwardly. As such, the rear edge of the support surface forces the extension beam 214 to pivot down, and the rear end 215 of the base step 172 to disengage from the protuberance 220. Motion of the base step 172 and the intermediary transition step 170 is reversed from the movement into the extended position, such that the links 190 pivot the intermediary transition step 170 back down to a retracted position, and the restraining pins 192 securely couple the intermediary transition step 170 to the frame 102 in a retracted position.

Figure 8:
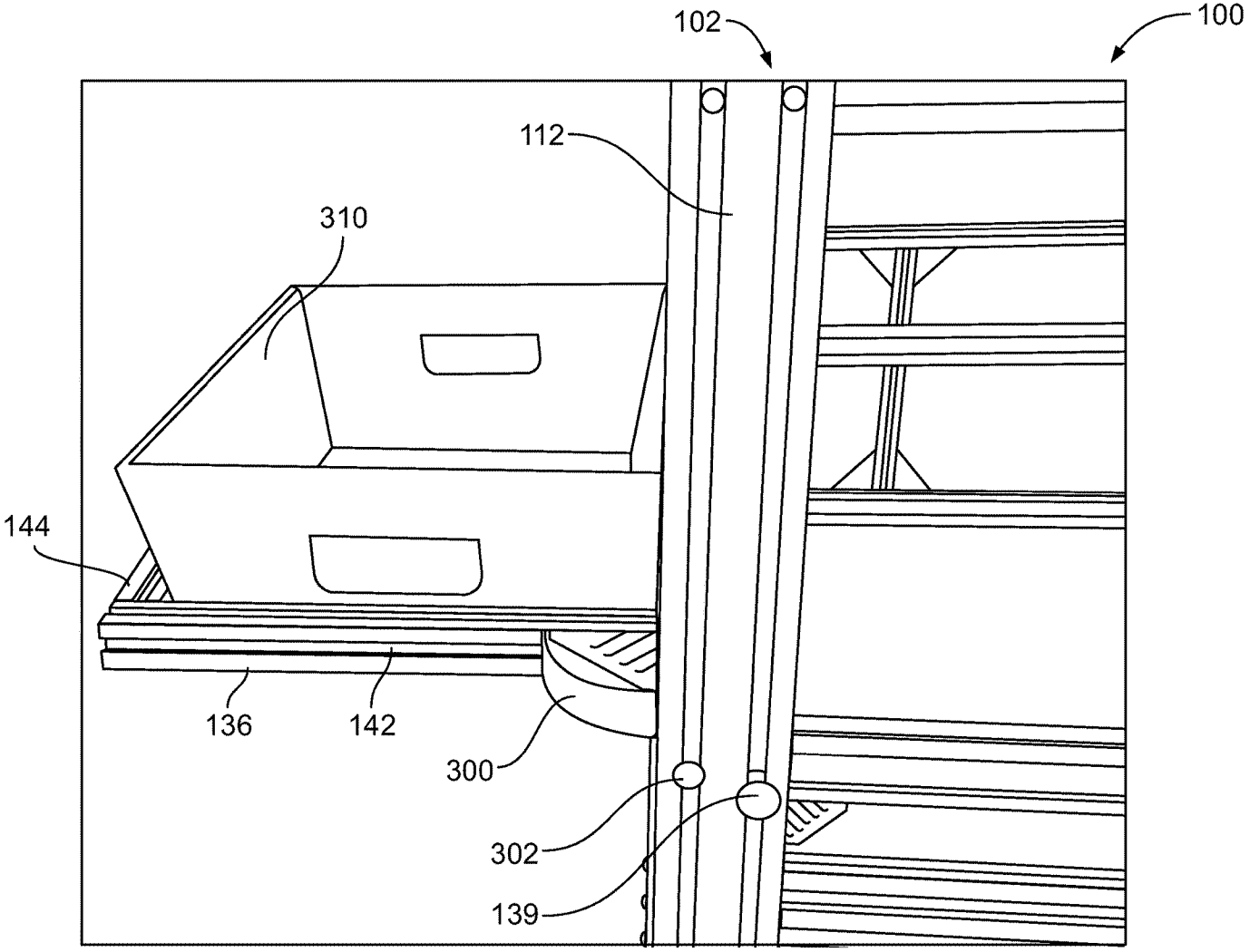
FIG. 8 illustrates a lateral view of a support tray of a platform system in an extended position, according to an embodiment of the present disclosure.

FIG. 8 illustrates a lateral view of the support tray 136 of the platform system 100 in an extended, component-supporting position, according to an embodiment of the present disclosure. Referring to FIGS. 1 and 8, the support tray 136 may be pivotally coupled between the posts 110 and 112. The pivot bracket 138 (hidden from view in FIG. 8) pivotally couples to interior portions of the posts 110 and 112 through the pivot pin(s) 139. The support tray 136 may be pivoted into the extended position about the pivot pin(s) 139. In the extended position, bracing locks 300 may be used to lock the support tray 136 in the extended position. For example, the bracing locks 300 may be wedge shaped and fit between the lateral beams 140 and 142 and the posts 110 and 122, respectively. Locking pins 302 may pass through channels formed through the posts and couple to the bracing locks 300 to securely lock the support tray 136 in the extended position. The pivot bracket 138 may be adjusted to a desired level with respect to the posts 110 and 112, such as through channels formed through the posts 110 and 112 at various heights. That is, the pivot pin(s) 139 and the locking pins 302 may be configured to be removably coupled to channels at different heights of the posts 110 and 112, so that the support tray 136 may be adjusted to various different levels. As shown, the support trays 136 receives and retains a container 310, such as a bucket, tray, and/or the like, between the pivot bracket 138, the lateral beams 140, 142, and the outer cross beam 144. The container 310 may hold tools, fasteners, components, and/or the like.

Referring to FIGS. 1-8, as described above, embodiments of the present disclosure provide a stable, portable, and maneuverable platform system. Embodiments of the present disclosure provide a standing platform system that allows individuals to safely and freely maneuver thereon at various different heights. Embodiments of the present disclosure provide a standing platform system that may be adjusted to different heights, and adapted to various environments.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical (or various other angles or orientations), and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A platform system that is configured to allow an individual to be supported at a plurality of different heights, the platform system comprising:

a frame defining a plurality of platform adjustment levels, the frame including a first post, a second post, a third post, and a fourth post;

an upper support platform that is configured to be removed and reinserted into any of the plurality of platform adjustment levels to provide the plurality of different heights;

a base step moveably coupled and secured to the frame, wherein the base step is below the upper support platform, wherein the base step is configured to be outwardly moved between a fully retracted position within the frame and a fully extended position in relation to the frame, and wherein the base step is configured to support the individual in the fully extended position; and a support tray pivotally coupled between the third post and the fourth post of the frame, wherein the support tray includes a pivot bracket pivotally coupled to interior portions of the third post and the fourth post through one or more pivot pins, the support tray pivotable into an extended position about one of the pivot pins and locked in the extended position by at least one bracing lock, at least one locking pin configured to be removably coupled at different heights along the third post and the fourth post, so that the support tray is adjustable to various different levels along the third post and the fourth post.

2. The platform system of claim 1, wherein the plurality of platform adjustment levels comprise a first platform adjustment level and a second platform adjustment level, wherein the upper support platform is configured to be completely removed from the first platform adjustment level and inserted into the second platform adjustment level.

3. The platform system of claim 1, wherein the plurality of platform adjustment levels comprise a first platform adjustment level and a second platform adjustment level, wherein the first platform adjustment level is spaced from the second platform adjustment level that is adjacent to the first platform adjustment level a distance of two inches.

4. The platform system of claim 1, wherein the base step includes a handle that is configured to be grasped, wherein the handle is formed on a support surface of the base step, and wherein the support surface is configured to support the individual.

5. The platform system of claim 1, further comprising a moveable intermediate transition step underneath the upper support platform.

6. The platform system of claim 5, wherein the intermediate transition step is moveably coupled to the base step through at least one pivotal link.

7. The platform system of claim 5, wherein the intermediate transition step upwardly extends when the base step is in the fully extended position.

8. The platform system of claim 1, wherein the frame includes a plurality of rails, wherein the plurality of platform adjustment levels are defined between the plurality of rails.

9. The platform system of claim 1, further comprising casters connected to the frame, wherein the casters are configured to allow the platform system to be moved to different locations.

10. The platform system of claim 9, further comprising handles extending from the frame, wherein the handles are configured to be grasped to tilt the platform system onto the casters.

11. The platform system of claim 10, wherein at least one of the plurality of beams comprises a moveable safety beam that is configured to be moved between closed and open positions, wherein the safety beam is pivotally coupled to the first post of the frame and removably coupled to the second post of the frame, wherein the safety beam is coupled to the first post and the second post in the closed position, and wherein the safety beam is connected to the first post and decoupled from the second post in the open position.

12. The platform system of claim 1, wherein the frame comprises a plurality of beams that provide barriers that restrain movement of the individual.

13. The platform system of claim 1, wherein the support tray defines an open channel that is configured to receive a container.

14. The platform system of claim 1, wherein the plurality of platform adjustment levels comprise twelve platform adjustment levels.

15. A platform system that is configured to allow an individual to be supported at a plurality of different heights, the platform system comprising:

a frame including a plurality of rails defining a plurality of platform adjustment levels, and a plurality of beams that provide barriers that restrain movement of the individual, wherein at least one of the plurality of beams comprises a moveable safety beam that is configured to be moved between closed and open positions, wherein the plurality of platform adjustment levels comprise a first platform adjustment level and a second platform adjustment level, wherein the safety beam is pivotally coupled to a first post of the frame and removably coupled to a second post of the frame, wherein the safety beam is coupled to the first post and the second post in the closed position, and wherein the safety beam is connected to the first post and decoupled from the second post in the open position;

casters connected to the frame, wherein the casters are configured to allow the platform system to be moved to different locations;

handles extending from the frame, wherein the handles are configured to be grasped to tilt the platform system onto the casters;

a support tray pivotally coupled between a third post and a fourth post of the frame, wherein the support tray includes a pivot bracket pivotally coupled to interior portions of the third post and the fourth post through one or more pivot pins, the support tray pivotable into an extended position about one of the pivot pins and locked in the extended position by at least one bracing lock, at least one locking pin configured to be removably coupled at different heights along the third post and the fourth post, so that the support tray is adjustable to various different levels along the third post and the fourth post;

an upper support platform that is configured to be removed and reinserted into any of the plurality of platform adjustment levels to provide the plurality of different heights, wherein the upper support platform is configured to be completely removed from the first platform adjustment level of the frame and inserted into the second platform adjustment level of the frame;

a base step moveably coupled and secured to the frame, wherein the base step is below the upper support frame, wherein the base step is configured to be outwardly moved between a fully retracted position within the frame and a fully extended position in relation to the frame, wherein the base step is configured to support the individual in the fully extended position; and a moveable intermediate transition step underneath the upper support platform, wherein the intermediate transition step is moveably coupled to the base step through at least one pivotal link, wherein the intermediate transition step upwardly extends when the base step is in the fully extended position.

16. The platform system of claim 15, wherein the first platform adjustment level is spaced from the second platform adjustment level that is adjacent to the first platform adjustment level a distance of two inches.

17. The platform system of claim 15, wherein the base step includes a grasp handle formed on a support surface of the base step, and wherein the support surface is configured to support the individual.

18. The platform system of claim 15, wherein the support tray defines an open channel that is configured to receive a container.

* * * * *